US006352590B1

(12) United States Patent
Hess

(10) Patent No.: US 6,352,590 B1
(45) Date of Patent: Mar. 5, 2002

(54) DEVICE FOR MOISTENING WEB-SHAPED MATERIAL

(75) Inventor: Günter Hess, Reutlingen (DE)

(73) Assignee: Weitmann & Konrad GmbH & Co. KG, Leinfelden-Echterdingen (DE)

( * ) Notice: Subject to any disclaimer, the term of this patent is extended or adjusted under 35 U.S.C. 154(b) by 0 days.

(21) Appl. No.: 09/334,656

(22) Filed: Jun. 17, 1999

(30) Foreign Application Priority Data

Feb. 12, 1999 (DE) ..... 199 05 824

(51) Int. Cl.[7] ..... B05C 5/02

(52) U.S. Cl. ..... 118/678; 118/712; 118/314; 118/325; 101/147; 162/206; 162/207

(58) Field of Search ..... 118/678, 712, 118/46, 314, 325, 58; 101/147, 132.5; 239/548; 162/206, 207; 34/61, 636, 638, 643; 427/377, 398.3, 398.4

(56) References Cited

U.S. PATENT DOCUMENTS 3,406,960 A 10/1968 Del Vecchio et al.
5,813,332 A * 9/1998 Reichel-Langer et al. .. 101/147
5,914,008 A * 6/1999 Winheim ..... 162/206

FOREIGN PATENT DOCUMENTS

| | | |
|---|---|---|
| DE | 312388 | 11/1918 |
| DE | 1 101 447 | 3/1961 |
| DE | 9320455.8 | 10/1994 |
| DE | 19615198 C1 | 7/1997 |
| WO | WO 97/21544 | 6/1997 |

OTHER PUBLICATIONS

Patent Abstracts of Japan, 7–216720, Aug. 15, 1995, Mitani Yoshitoshi et al, "Moisturizing Apparatus".

Patent Abstracts of Japan, 9–26732, Jan. 28, 1997, Tsukamoto Takeo et al, "Both–Side Image Forming Device".

* cited by examiner

*Primary Examiner*—Laura Edwards
(74) *Attorney, Agent, or Firm*—Jones, Tullar & Cooper, P.C.

(57) ABSTRACT

The present invention relates to a device for moistening a web-shaped material, wherein the moistening device is designed as a device for mobile use, and wherein the web-shaped material can be laterally pushed into the moistening device.

16 Claims, 3 Drawing Sheets

DEVICE FOR MOISTENING WEB-SHAPED MATERIAL

FIELD OF THE INVENTION

The present invention relates to a device for moistening web-shaped material, such as paper webs or the like, an inlet opening and an outlet opening for the web-shaped material, and having an applicator device for a fluid, in particular a liquid, provided between the inlet opening and the outlet opening.

BACKGROUND OF THE INVENTION

A moistening device for a paper web for offset printing is known from German patent DE 42 27 136. After the drying process, in which the paper web passes through a drying station where the printing ink is dried, it is re-moistened by means of this moistening device. This is necessary since the water content of the paper web is reduced during the drying process, because of which not only changes in dimension occur, but the paper web is also negatively changed with respect to its static charge and its processing properties. The liquid which was lost during the drying process is added to the paper web by the moistening device, so that it can be optimally processed further. It has been shown that with digital printing which, for example, is known from the copying process, the paper is also heated so strongly during the fixation process that the moisture content of the paper is changed so much that the paper takes on a static charge, or that there are even deformations and dimensional changes. This results in interferences with the further processing of the paper web. With two-sided printing in particular, the second print is as a rule applied at a reduced size, because the paper web has shrunk after the first printing and the heat treatment for fixation of the toner.

SUMMARY OF THE INVENTION

The object of the present invention is based on making available a device for moistening web-shaped material, which can be employed without problems, in particular also in connection with digital printing.

This object is attained in a device for moistening of web-shaped material of the type mentioned at the outset, in that the inlet opening and the outlet opening are provided between at least two moistening arms, and that the inlet opening and the outlet opening are connected with each other via an open-edged slit extending between the arms.

The device in accordance with the present invention has the essential property that the web-shaped material, for example an endless paper web, can be inserted between the two arms via the openedged slit without cutting through the paper web, so that now the paper web can be moistened between the inlet opening and outlet opening during the passage through the moistening device. The digital printing device can be used without the moistening device, and the moistening device can be connected downstream of the printing press later, i.e. when needed, in that the web-shaped material is laterally inserted in the moistening device. The web-shaped material now additionally passes through the moistening device and can thereafter be worked on, or respectively processed, in the customary manner; for example, the second side can be printed, or the paper web can be fed to a separating device.

Since there is no mechanical action at all on the paper web, i.e. the paper web freely passes through the moistening device, the paper web can pass through the moistening device continuously or discontinuously, even with a slight return movement. There is also no need for conveyance devices for the paper web which passes through the moistening device, because it is being pulled through the moistening device by the next following device.

In connection with a further development it is provided, that the inlet opening and the outlet opening are located at different levels. In this way the paper web passes through the moistening device at a given slope, ie. from the top to the bottom, or respectively the bottom to the top. Because of the sloping passage, the moistening device can be inserted without problems between a printing device and a machine for further processing, and the sagging web section located between the two devices can be inserted into the moistening device.

In order to achieve an optimal insertion into, or respectively removal of the paper web from the moistening device, the inlet opening and/or the outlet opening each have two guide rollers for the web-shaped material. These guide rollers assure optimum guidance even if the web-shaped material arrives at an angle which is different in relation to the sloping passage.

A cost-efficient and simple structure of the moistening device is achieved in that both arms are designed to be the same to the greatest degree. In a preferred way the applicator devices are turned around their longitudinal axes inside the arms in such a way that they are optimally directed onto the paper web. In this case the moistening fluid is obliquely sprayed by the one applicator device from the top to the bottom onto the upper surface of the paper web, and by the other applicator device located in the other arm obliquely from the bottom to the top on the underside of the paper web. The applicator device for the fluid is constituted, for example, by a bar having several spraying rotors or several nozzles. The bar is supplied with liquid centrally from a reservoir.

In accordance with a preferred exemplary embodiment, the applicator device is provided with at least one cover shield, a slide or the like, for the temporary interruption of the moistening process. This cover shield, or respectively the slide, is displaced in front of the applicator opening when the paper web is stopped, so that the sprayed liquid can no longer reach the paper web. Instead, the liquid, which is stopped by the cover shield, is returned into the reservoir.

Preferably a motion sensor is provided for the web-shaped material, by means of which the speed, and also the conveyance, or respectively the stopping, of the paper web is detected. As already mentioned, when the web is stopped, the liquid application on the paper web is halted. Moreover, with a preferred exemplary embodiment the amount of liquid dispensed can be matched to the speed of the paper web. Customarily, however, the paper web runs at an even speed, so that an adjustment of the amounts is not required. In this case the amount of liquid to be dispensed is then set one time to an optimal amount and is merely readjusted when required.

The design of the moistening device as a device for mobile use opens a further field of use for to the device, not only with a single, but with several machines, and it can be integrated when needed and removed when no longer required. A further adaptation of the moistening device to an existing printing press is achieved in that the arms are height-adjustable, or can be fastened on a support frame at different heights. In this way, the optimally passed through the moistening device.

The entire device can be displaced or turned on the floor for the optimal alignment and adaptation of the guide rollers to the passing paper web. The device has three rollers, one of which is height-adjustable and can be manually fixed in place with respect to its turning properties.

Further advantages, characteristics and details of the invention ensue from the following description, in which a preferred exemplary embodiment will be explained in detail, making reference to the drawings. In this case the characteristics represented in the drawings and mentioned in the claims and the description can be essential for the present invention either individually or in any arbitrary combination.

DESCRIPTION OF THE PREFERRED EMBODIMENTS

Figure 1:
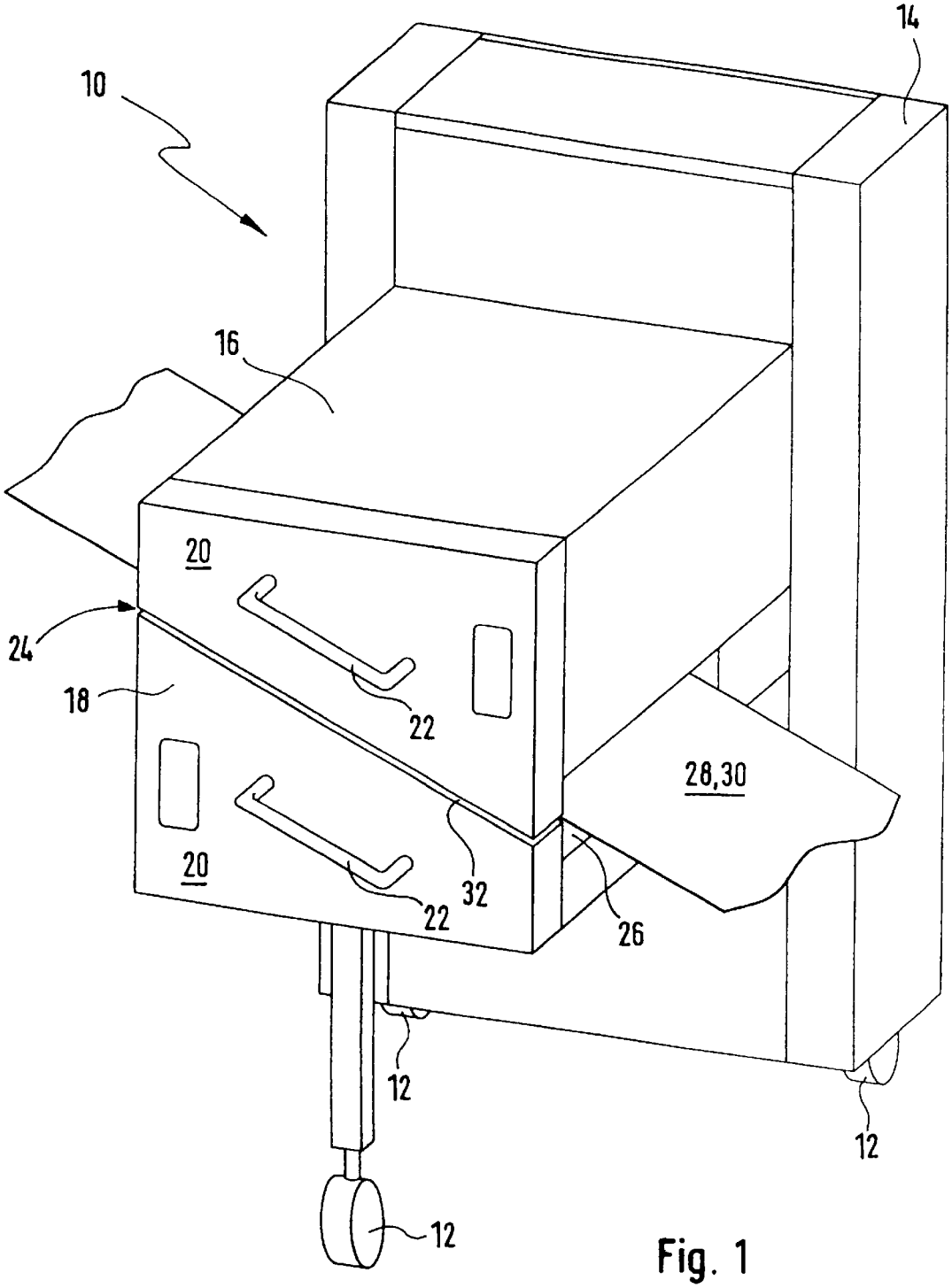
FIG. 1, is a perspective view of the moistening device according to the present invention.

FIG. 1 represents an exemplary embodiment of the moistening device 10 in accordance with the present invention, which is designed as a device for mobile use with rollers 12. The moistening device 10 has a support frame 14, on which two freely protruding arms 16 and 18, which can altogether be height-adaptable, or respectively height-adjustable, are fastened. Two handles 22 are fastened on the front ends 20 of the arms 16 and 18, by means of which the moistening device 10 can be transported, i.e. displaced.

The moistening device 10 has an inlet opening 26 and an outlet opening 24 through which a web-shaped material 28, namely a paper web 30, can be introduced into the moistening device 10 and moved out of it. The inlet opening 26 and the outlet opening 24 are connected with each other via an open-edged slit 32. The paper web 30 can be laterally pushed through this open-edged slit 32 between the arms 16 and 18 without it being necessary to change the position of the arms 16 and 18, or respectively having to cut the paper web 30.

Figure 2:
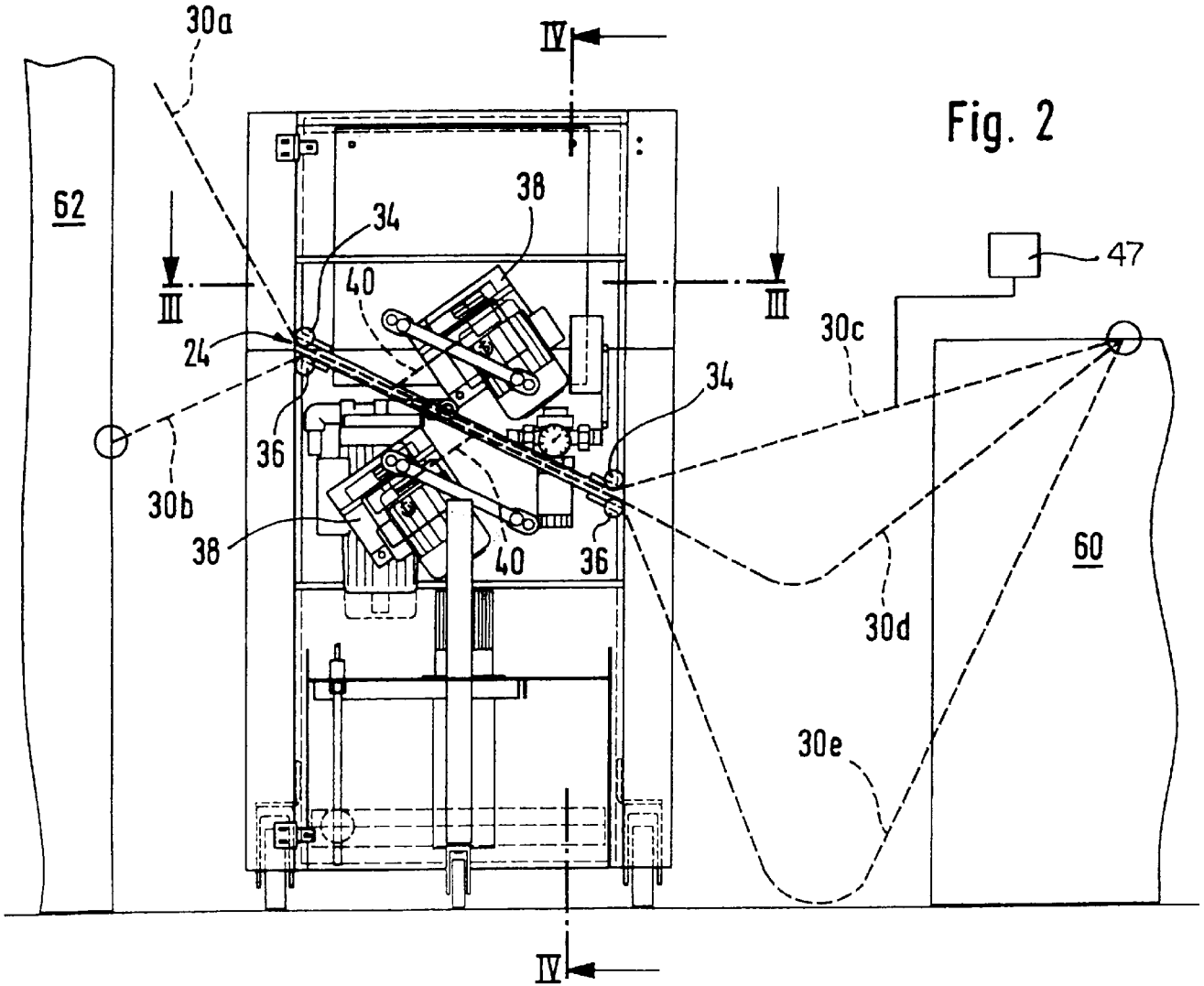
FIG. 2, is a vertical sectional view through the moistening device.

Several courses of the web 30 identified by 30*a*, 30*b*, 30*c*, 30*d* and 30*e* are represented in FIG. 2. The inlet opening 26 as well as the outlet opening 24 are each provided with two guide rollers 34 and 36, between which the paper web 30 can be exactly introduced between the two arms 16 and 18, or respectively moved out of them. Moreover, it can be clearly seen that the inlet opening 26 is placed lower than the outlet opening 24, and that the course of the web within the moistening device 10 defines an upward slope from the bottom to the top.

Respectively one applicator device 38 for the liquid to be applied, which is respectively sprayed obliquely (as indicated by the dashed line 40) onto the paper web 30, is located inside the arm 16 as well as inside the arm 18.

Figure 3:
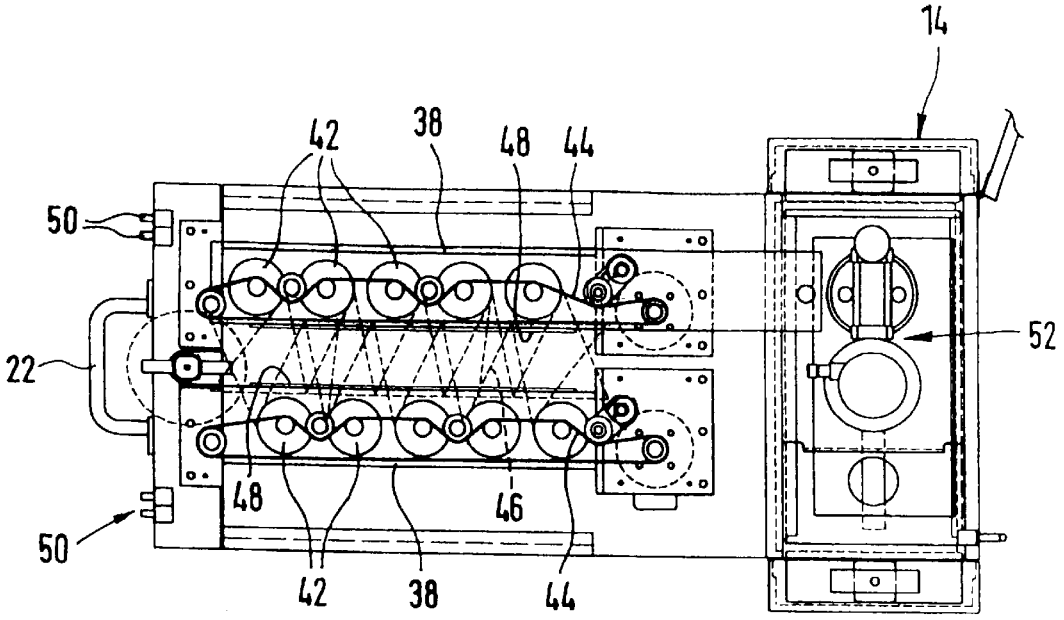
FIG. 3, is a section along the line III—III of FIG. 2.
Figure 4:
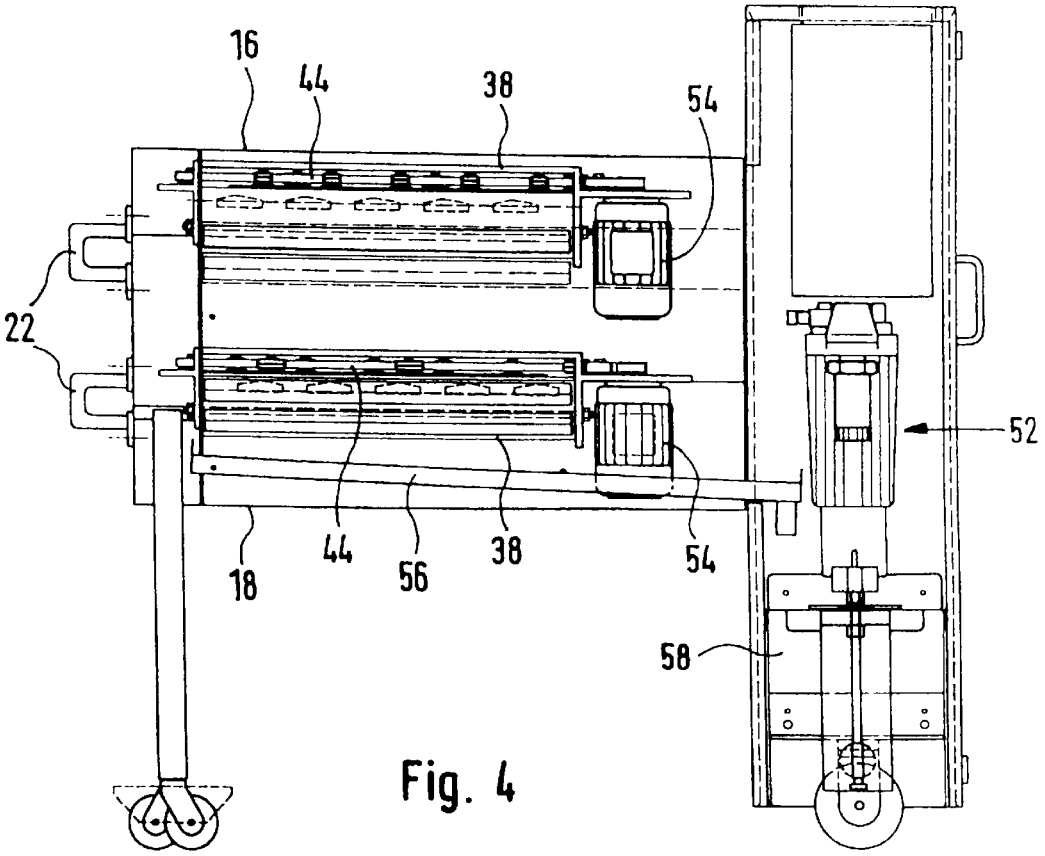
FIG. 4, is a section along the line IV—IV of FIG. 2.

The two applicator devices 38 are shown in greater detail in FIG. 3, and the rotors 42, which are driven by a common drive belt 44 (respectively one belt per applicator device 38). The spray cones 46 of the rotors 42 are sketched in. Respectively one cover shield 48 is located at the outlet of the rotors 42 and can be displaced, for example by means of an electromagnet, in front of the outlet openings 42, or respectively positioned so that it unblocks them. It is possible in this way to specifically moisten, or respectively not moisten, the paper web 30. The control of the two cover shields 48 is performed by means of a motion sensor 47, for example, which detects the conveying of the paper web 30. This motion sensor is, for example, a wheel with an inductive transmitter seated on the paper web, which reports a stoppage of the paper web immediately or with a delay to a control device. arm 18. Liquid which had not been sprayed and which, for example, had been held back by means of the cover shield 48, is returned to the reservoir 58 via the return trough 56.

It is possible without problems by means of the moistening device 10 in accordance with the invention to moisten a paper web between a printing device 60 (only sketched in) and a device 62 for further processing, in that the mobile moistening device 10 is inserted between the printing device 60 and the device 62 for further processing in such a way that the paper web 30 passes between the two arms 16. It is merely required to push the paper web 30 through the open-edged slit 32 between the two arms 16 and 18.

What is claimed is:

1. A mobile device for moistening web-shaped material, comprising:

support means;

two arms each extending in a horizontal direction from said support means and each defining a free end, said two arms being vertically adjustable relative to said support means, said two arms together defining an inlet opening, an outlet opening and an open-edged slit at their free ends connecting said inlet opening and said outlet opening and allowing lateral insertion of the web-shaped material between said two arms; and an applicator device in at least one of said two arms, and situated between said inlet opening and said outlet opening for providing fluid to the web-shaped material as it moves between said inlet opening and said outlet opening.

2. The device as defined in claim 1, further comprising:

two guide rollers for the web-shaped material located at at least one of said inlet opening and said outlet opening.

3. The device as defined in claim 1, wherein said two arms have essentially similar designs.

4. The device as defined in claim 1, wherein each of said two arms is provided with one of said applicator devices.

5. The device as defined in claim 1, wherein each said applicator device includes a bar having several spray nozzles mounted thereto.

6. The device as defined in claim 1, wherein the fluid is applied by said applicator device to the web-shaped material at an angle to the horizontal.

7. The device as defined in claim 1, wherein said inlet opening serves as an outlet and said outlet opening serves as an inlet.

8. The device as defined in claim 1, further comprising:

means connected to said applicator device for regulating the amount of fluid applied to the web-shaped material by said applicator device.

9. The device as defined in claim 1, wherein the web-shaped material is paper or the like.

10. A device for moistening web-shaped material, comprising:

support means;

two arms each extending from said support means and each defining a free end, said two arms together defining an inlet opening, an outlet opening and an open-edged slit at their free ends connecting said inlet opening and said outlet opening; and an applicator device in at least one of said two arms, and situated between said inlet opening and said outlet opening for providing fluid to the web-shaped material as it moves between said inlet opening and said outlet opening, wherein said inlet opening and said outlet opening are located at different vertical heights.

11. A device for moistening web-shaped material, comprising:

support means;

two arms each extending from said supprot means and each defining a free end, said two arms together defining an inlet opening, an outlet opening and an open-edged slit at their free ends connecting said inlet opening and said outlet opening; and an applicator device in at least one of said two arms, and situated between said inlet opening and said outlet opening for providing fluid to the web-shaped material as it moves between said inlet opening and said outlet opening, wherein said open-edged slit extends obliquely between said two arms.

12. A device for moistening web-shaped material, comprising:

supprot means;

two arms each extending from said support means and each defining a free end, said two arms together defining an inlet opening, an outlet opening and an open-edged slit at their free ends connecting said inlet opening and said outlet opening;

an applicator device in at least one of said two arms, and situated between said inlet opening and said outlet opening for providing fluid to the web-shaped material as it moves between said inlet opening and said outlet opening; and a motion sensor for sensing the movement of the web-shaped material.

13. A device for moistening web-shaped material, comprising:

support means;

two arms extending from said support means and each defining a free end, said two arms together defining an inlet opening, an outlet opening and an open-edged slit at their free ends connecting said inlet opening and said outlet opening;

an applicator device in at least one of said two arms, and situated between said inlet opening and said outlet opening for providing fluid to the web-shaped material as it moves between said inlet opening and said outlet opening; and a support frame to which said two arms are mounted to be height-adjustable relative to said support frame.

14. The device as defined in claim 13, wherein said two arms are height-adjustable manually.

15. The device as defined in claim 13, further comprising:

an electric motor for height adjusting said two arms.

16. A device for moistening web-shaped material, comprising:

support means;

two arms each extending from said support means and each defining a free end, said two arms together defining an inlet opening, an outlet opening and an open-edged slit at their free ends connecting said inlet opening and said outlet opening; and an applicator device in at least one of said two arms, and situated between said inlet opening and said outlet opening for providing fluid to the web-shaped material as it moves between said inlet opening and said outlet opening, wherein each said applicator device includes a cover shield for temporarily interrupting the application of fluid to the web-shaped material.

* * * * *